US008002971B2

(12) United States Patent
Kozyuk

(10) Patent No.: US 8,002,971 B2
(45) Date of Patent: Aug. 23, 2011

(54) DESULFURIZATION PROCESS AND SYSTEMS UTILIZING HYDRODYNAMIC CAVITATION

(75) Inventor: Oleg V. Kozyuk, N. Ridgeville, OH (US)

(73) Assignee: Arisdyne Systems, Inc., Cleveland, OH (US)

( * ) Notice: Subject to any disclaimer, the term of this patent is extended or adjusted under 35 U.S.C. 154(b) by 553 days.

(21) Appl. No.: 12/135,636

(22) Filed: Jun. 9, 2008

(65) Prior Publication Data

US 2009/0008295 A1 Jan. 8, 2009

Related U.S. Application Data

(63) Continuation-in-part of application No. 10/969,682, filed on Oct. 20, 2004, now abandoned.

(51) Int. Cl.
*C10G 29/04* (2006.01)
*C10G 17/02* (2006.01)

(52) U.S. Cl. ..... 208/219; 208/196; 208/208 R; 208/240; 208/243; 208/244; 208/245; 208/246; 208/307; 366/176.2; 138/137; 138/140

(58) Field of Classification Search ..... 208/196, 208/208 R, 219, 240, 243, 244, 245, 307, 208/246; 138/137, 140; 366/176.2
See application file for complete search history.

(56) References Cited

U.S. PATENT DOCUMENTS 3,505,210 A * 4/1970 Heimlich et al. ..... 208/228
3,647,683 A 3/1972 Kelley et al.
5,368,054 A * 11/1994 Koretsky et al. ..... 134/153
5,810,052 A 9/1998 Kozyuk
5,937,906 A 8/1999 Kozyuk
5,958,224 A 9/1999 Ho et al.
5,969,207 A 10/1999 Kozyuk
5,971,601 A 10/1999 Kozyuk
6,012,492 A 1/2000 Kozyuk
6,402,939 B1 6/2002 Yen et al.
(Continued)

FOREIGN PATENT DOCUMENTS

WO 02074884 9/2002
(Continued)

OTHER PUBLICATIONS

U.S. Appl. No. 10/969,682; Office Action dated Sep. 25, 2006.
(Continued)

*Primary Examiner* — Prem C Singh
(74) *Attorney, Agent, or Firm* — Pearne & Gordon LLP

(57) ABSTRACT

Processes and systems associated with hydrodynamic cavitation-catalyzed oxidation of sulfur-containing substances in a fluid are described. In one example method, carbonaceous fluid is combined with at least one oxidant to form a mixture and then the mixture is flowed through at least one local constriction in a flow-through chamber at a sufficient pressure and flow rate to create hydrodynamic cavitation in the flowing mixture having a power density of between about 3,600 kWatts/cm$^2$ and about 56,000 kWatts/cm$^2$ measured at the surface of the local constriction normal to the direction of fluid flow. The creation of hydrodynamic cavitation in the flowing mixture initiates one or more chemical reactions that, at least in part, oxidize at least some of the sulfur-containing substances in the carbonaceous fluid. An example system includes a device configured to mix a carbonaceous fluid and one or more oxidants, at least one cavitation chamber configured to produce cavitation bubbles in the mixture, and at least one elevated pressure zone configured to collapse the cavitation bubbles, thereby catalyzing oxidation of the sulfur-containing substances.

22 Claims, 10 Drawing Sheets

U.S. PATENT DOCUMENTS

| | | | |
|---|---|---|---|
| 6,402,940 | B1 | 6/2002 | Rappas |
| 6,406,616 | B1 | 6/2002 | Rappas et al. |
| 6,500,219 | B1 | 12/2002 | Gunnerman |
| 6,502,979 | B1 | 1/2003 | Kozyuk |
| 7,086,777 | B2 | 8/2006 | Kozyuk |
| 2003/0014911 | A1 | 1/2003 | Gunnerman |
| 2004/0035753 | A1 | 2/2004 | Cullen |
| 2006/0081501 | A1 | 4/2006 | Kozyuk |

FOREIGN PATENT DOCUMENTS

| | | |
|---|---|---|
| WO | 2006044041 | 4/2006 |

OTHER PUBLICATIONS

U.S. Appl. No. 10/969,682; Office Action dated Apr. 3, 2007.
U.S. Appl. No. 10/969,682; Office Action dated Jul. 25, 2007.
U.S. Appl. No. 10/969,682; Office Action dated Jan. 8, 2008.
PCT/US2009/046574; Authorized Officer Schon, Micheala; International Search Report and Written Opinion dated Jul. 5, 2010.
A New Method for Obtaining Ultra-Low Sulfur Diesel Fuel Via Ultrasound Assisted Oxidative Desulfurization; Mei et al.; May 23, 2002.
Modeling of Hydrodynamic Cavitation Reactors: A Unified Approach; Moholkar et al.; Nov. 20, 2001.
A Review of Desulfurization of Light Oil Based on Selective Oxidation, Dishun et al.; http://www.chemistrymag.org/cji/2004/063017.htm; Mar. 21, 2004 vol. 6 No. 3 p. 17.
Unipure's Oxidative Desulfurization Process Creates New Market Opportunities for Supply of Ultra-Low Sulfur Fuels, Levy et al. prepared for presentation at AIChE 2002 Spring Meeting, New Orleans Mar. 13, 2002; Session on Non-Conventional Technology for Desulfurization, Copyright UniPure Corp. Dec. 2001.
Mei H et al: "A new method for obtaining ultra-low sulfur diesel fuel via ultrasound assisted oxidative desulfurization" Fuel, IPC Science and Technology Press, Guildford, GB LNKD-D01:10.1016/S0016-2361-(02)00318-6, vol. 82, No. 4, Mar. 1, 2003, pp. 405-414, XP004397440 ISSN: 0016-2361.
Moholkar et al:: "Modelling of hydrodynamic cavitation reactors: a unified approach" Chemical Engineering Science, Oxford, GB, vol. 56, Nov. 20, 2001, pp. 6295-6302, XP002578329 ISSN: 0009-2509 [retrieved on Apr. 19, 2010].

* cited by examiner

DESULFURIZATION PROCESS AND SYSTEMS UTILIZING HYDRODYNAMIC CAVITATION

CROSS-REFERENCE TO RELATED APPLICATION

This application is a continuation-in-part of U.S. application Ser. No. 10/969,682 filed on Oct. 20, 2004, the disclosure of which is hereby incorporated by reference in its entirety herein.

BACKGROUND

The presence of sulfur-containing substances or compounds (e.g., organic sulfur) in certain fluids, like carbonaceous fluids or solutions of hydrocarbons, may be undesirable. For example, sulfur in petroleum-based fluids may contribute to polluting air, water, soil, and the like, as the fluids are used and sulfur is potentially released into the environment. It may be desirable to reduce or remove the sulfur-containing compounds in, for example, fuels and oils before they are burned, combusted or otherwise used, and sulfur contained in the fluids is released.

Methods for removing or reducing the amount of sulfur-containing compounds in carbonaceous fluids are available. These methods may be called desulfurization methods. In one desulfurization method, called hydrotreating or hydrosulfurization, carbonaceous fluids and hydrogen may be treated at high temperature and pressure in the presence of catalysts. Sulfur may be reduced to $H_2S$ gas which then may be oxidized to elemental sulfur.

In another method, called oxidative desulfurization, sulfur-containing compounds may be oxidized and then removed from a fluid based on one or more properties of the oxidized sulfur-containing compounds. Oxidative desulfurization may use a variety of different oxidants as well as different conditions to initiate the oxidation reactions. In one example, sulfur-containing compounds in small volumes of a carbonaceous fluid may be oxidized using a peroxy oxidant in the presence of ultrasonic energy that produces cavitation bubbles in the fluid. This method of producing cavitation bubbles may be called acoustic cavitation.

Many of the methods for removing sulfur-containing compounds from carbonaceous fluids may be costly, may include harsh reaction conditions, may be unable to remove substantial amounts of sulfur-containing compounds, may be unable to remove sulfur-containing compounds having certain chemical structures, may not facilitate scale-up to large volumes of fluids, and so on.

BRIEF DESCRIPTION OF THE DRAWINGS

The accompanying drawings, which are incorporated in and constitute a part of the specification, illustrate various example methods, systems, and so on, relating to various example embodiments of oxidation of sulfur-containing compounds using hydrodynamic cavitation and desulfurization of a fluid. The drawings are for the purposes of illustrating the preferred and alternate embodiments and are not to be construed as limitations. For example, it will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale and distances may be exaggerated for purposes of explanation.

DETAILED DESCRIPTION

Figure 1:
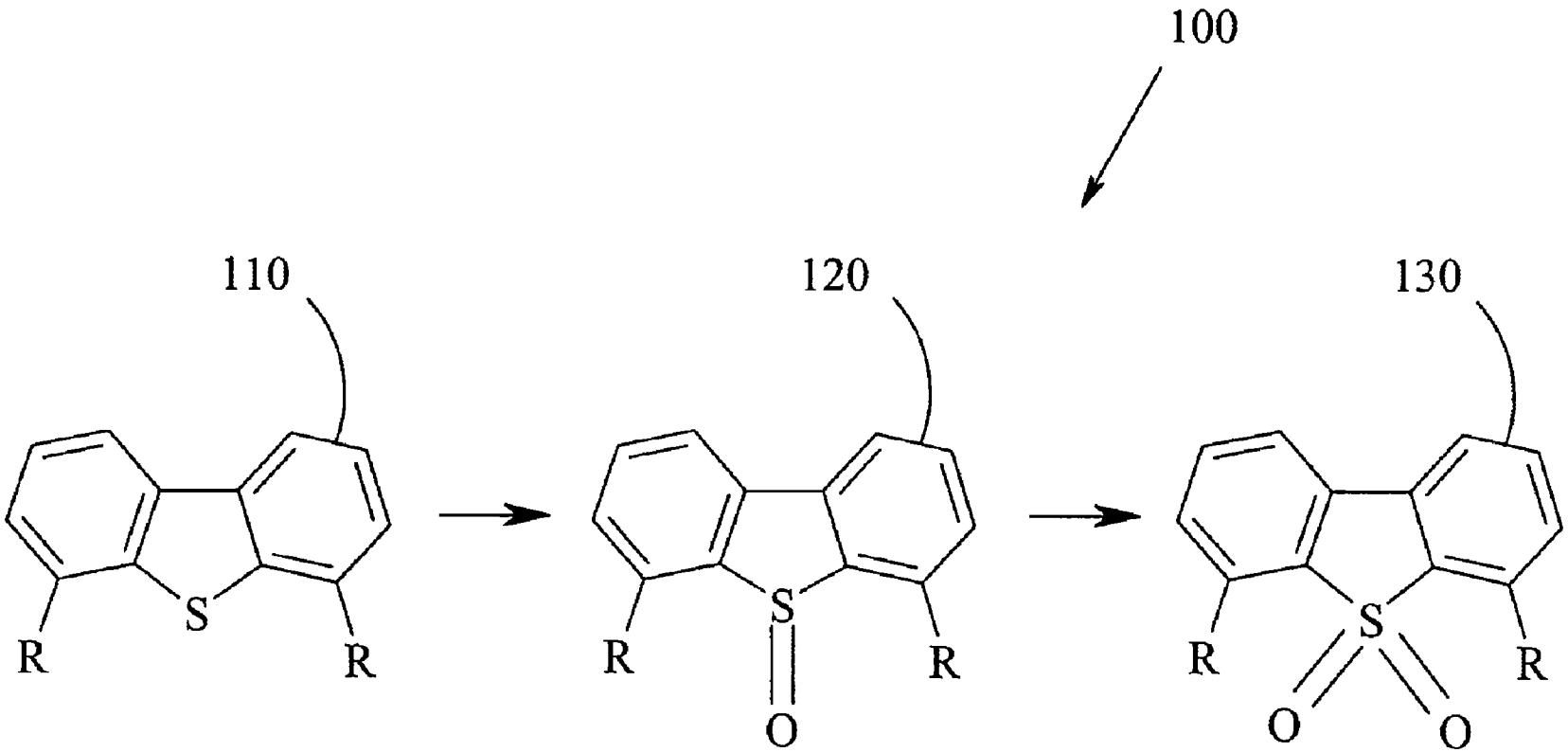
FIG. 1 illustrates chemical structures of an example sulfur-containing compound 100 and example oxidized forms.

This application describes processes and systems related to oxidizing sulfur-containing substances in a fluid. Oxidizing the sulfur-containing substances may facilitate their removal from the fluid. The example processes and systems generally include producing hydrodynamic cavitation in a mixture of a fluid containing sulfur-containing substances and one or more oxidizing agents. Hydrodynamic cavitation may include producing cavitation bubbles in the mixture by creating low pressure areas in the mixture. Hydrodynamic cavitation may also include collapsing the cavitation bubbles, thereby producing conditions that may initiate or catalyze one or more oxidation reactions that may oxidize or partially oxidize the sulfur-containing substances. Generally, the oxidation reactions may not oxidize other substances in the fluids, like petroleum-based substances, for example. The oxidized or partially oxidized sulfur-containing substances may be removed from the fluid using a variety of methods. The methods and systems disclosed herein generally produce fluids containing a reduced amount of various sulfur-containing substances.

The fluids containing sulfur-containing compounds that may be oxidized by the methods and systems using oxidative desulfurization, and may be removed from the fluids, may be of a variety of types. In one example, the fluids may contain carbon and may be called carbonaceous fluids or organic fluids. The carbon in the carbonaceous fluids may be part of carbon-containing compounds or substances. The carbon-containing compounds or substances may be hydrocarbons of a variety of types. One type of carbonaceous fluid may contain liquid hydrocarbons like fossil fuels, crude oil or crude oil fractions, diesel fuel, gasoline, kerosene, petroleum fractions, light oil, and others. Another type of carbonaceous fluid may contain solid hydrocarbons like coal. Another type of carbonaceous fluid may contain liquefied hydrocarbons like liquefied petroleum gas. Carbonaceous fluids may contain one or more of the liquid, solid, liquefied, and other hydrocarbons. The carbonaceous fluids may be petroleum-based fluids.

The sulfur-containing compounds and/or substances in the fluids may be of a variety of types. Examples of these compounds include, mercaptans (thiols), sulfides, disulfides, thiophenes, and others. The example thiophenes may be, for example, benzothiophenes or di-benzothiophenes.

Generally, the sulfur-containing compounds may be chemically apolar or at least chemically less polar than one or more oxidized or partially oxidized forms of the sulfur-containing compounds. In one example, the differences in the chemical polarity of the sulfur-containing compounds before they are subjected to oxidation, and the sulfur-containing compounds after they are subjected to oxidation, may be a basis for removal of the oxidized or partially oxidized forms of the sulfur-containing compounds from a fluid. Generally, the oxidized or partially oxidized sulfur-containing compounds may be chemically polar or at least more polar than one or more unoxidized forms of the sulfur-containing compounds.

Oxidizing or partially oxidizing the sulfur-containing compounds generally may occur through chemical oxidation reactions. In one example, oxidizing the sulfur-containing compounds includes chemical addition of one or more oxygen atoms to a sulfur atom. In one example, the one or more oxygen atoms may form covalent double bonds with the sulfur atoms. An example sulfur-containing compound containing a sulfur atom with an oxygen atom double-bonded to it may be called a sulfoxide. An example sulfur-containing compound containing a sulfur atom with two oxygen atoms double-bonded to it may be called a sulfone.

FIG. 1 illustrates chemical structures of an example sulfur-containing compound 100 and example oxidized forms. An example sulfur-containing compound 110 may be oxidized to a sulfoxide 120, by adding an oxygen atom to a sulfur atom in the compound and/or to a sulfone 130, by adding two oxygen atoms to a sulfur atom in the compound.

The chemistry that produces oxidized forms of sulfur-containing compounds generally may utilize one or more oxidizing agents or oxidants in the chemical reactions. The oxidizing agents may be of a variety of types. Example oxidizing agents may include hydrogen peroxide and water. Example oxidizing agents may include ozone. Example oxidizing agents may include hydroperoxides. Hydroperoxides may include monosubstitution products of hydrogen peroxide (i.e., dioxidane), having the chemical formula, ROOH, where R may be an organic group or an inorganic group. Examples of hydroperoxides in which R is an organic group are water-soluble hydroperoxides such as methyl hydroperoxide, ethyl hydroperoxide, isopropyl hydroperoxide, n-butyl hydroperoxide, sec-butyl hydroperoxide, tert-butyl hydroperoxide, 2-methoxy-2-propyl hydroperoxide, tert-amyl hydroperoxide, cyclohexyl hydroperoxide, and others. Examples of hydroperoxides in which R is an inorganic group are peroxonitrous acid, peroxophosphoric acid, peroxosulfuric acid, and others. Tertiary-alkyl peroxides, tert-butyl peroxide for example, are also oxidizing agents that may be used. Compounds of the ROOH type in which R is an acyl group may be called "peroxy acids." Peroxy acids may be organic peroxy acids, inorganic peroxy acids, peroxy salts, and others.

In one example, the oxidizing agents may react directly with the sulfur-containing compounds to produce oxidized forms of the sulfur-containing compounds. In one example, the oxidizing agents may be reacted with one or more other substances to produce a form that is reactive with a sulfur-containing compound (e.g., a activated oxidizing agent). In another example, the chemical reactions that produce oxidized forms of sulfur-containing compounds may include one or more reaction or reaction steps. For example, a first chemical reaction may produce a reactive form of an oxidizing agent which can react with a sulfur-containing compound in a second reaction to produce an oxidized form of the sulfur-containing compound.

Generally, the amount of oxidizing agents used to oxidize sulfur-containing compounds may be controlled, for example, to optimize efficiency of oxidation of sulfur-containing compounds, to limit the amount of oxidation to substances in the fluid that do not contain sulfur, and for other reasons. For example, in subjecting diesel fuel to oxidation by hydrodynamic cavitation, the amount of oxidizing agents used may be sufficient for oxidizing or partially oxidizing sulfur-containing compounds, but generally may not be sufficient for oxidizing hydrocarbon compounds of the diesel fuel. In one example, the amount of oxidizing agents may be between about 0.05 and about 30 weight percent of a mixture of a carbonaceous fluid and oxidizing agents. In another example, the amount of oxidizing agents may be between about 2 and about 4 weight percent of a carbonaceous fluid and oxidizing agents.

The chemical reactions that produce reactive oxidants, that produce oxidized sulfur-containing compounds, and related reactions may use energy to initiate, catalyze or facilitate completing the one or more reactions. At least some of this energy may be provided by hydrodynamic cavitation. Hydrodynamic cavitation may include producing cavitation bubbles in a fluid. The cavitation bubbles may result from a localized pressure drop in the fluid. Hydrodynamic cavitation may also include collapsing the cavitation bubbles. Collapsing cavitation bubbles may create large pressure impulses (e.g., shockwaves), high temperature conditions, high-shear conditions, sonoluminescent light (e.g., ultraviolet light), and other local energy conditions. These energy conditions may catalyze or partially catalyze the chemical reactions. One or more of, generating reactive oxidizing agents, and oxidizing sulfur-containing compounds, may then occur in and surrounding the area where cavitation bubbles are collapsing, and have collapsed.

The chemical reactions that produce oxidized forms of sulfur-containing compounds may also use one or more catalysts to initiate, catalyze or facilitate completing the one or more of the reactions. In one example, the catalysts are metallic catalysts. Examples of these catalysts are Fenton catalysts (ferrous salts) and metal ion catalysts in general such as iron (II), iron (III), copper (I), copper (II), chromium (III), chromium (VI), molybdenum, tungsten, and vanadium ions. Nickel and formic acid catalysts may also be used. The metallic catalysts when present may be used in catalytically effective amounts, which means an amount that enhances the progress of the oxidation and/or related reactions. In one example, the catalytically effective amount may range from about 1 mM to about 300 mM of the catalyst or catalysts. In another example, the catalytically effective amount may range from about 10 mM to about 100 mM.

Also included in the mixture of a carbonaceous fluid, one or more oxidants and optional catalysts that lead to oxidation of sulfur-containing compounds may be one or more surface active agents that may promote the formation of an emulsion between organic and aqueous phases upon mixing fluids, but that may spontaneously separate the product mixture (e.g., after oxidation) into aqueous and organic phases suitable for separation by decantation or other simple phase separation procedures. One example of these surface active agents may be mineral oils.

Figure 2:
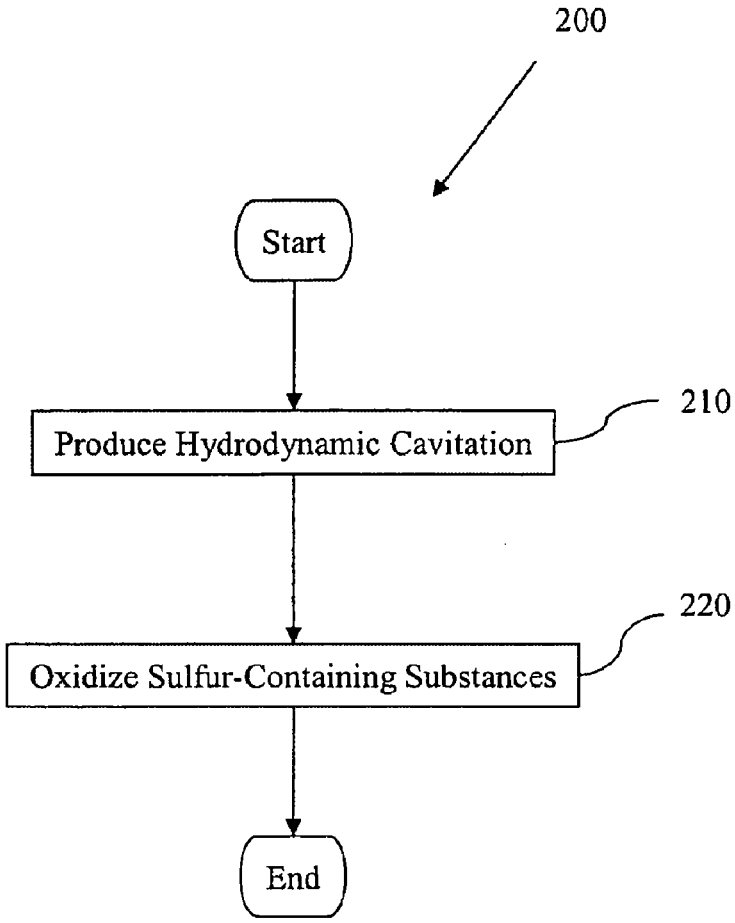
FIG. 2 is a flow diagram illustrating an example method 200 for oxidizing sulfur-containing substances in a fluid.
Figure 3:
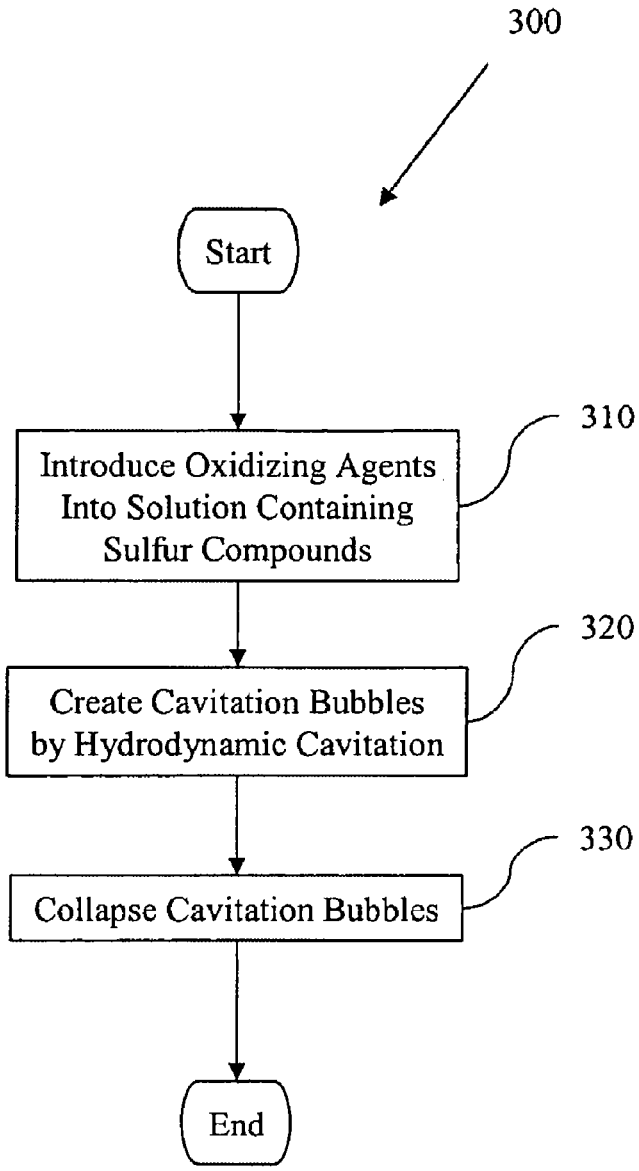
FIG. 3 is a flow diagram illustrating another example method 300 for oxidizing sulfur-containing substances in a fluid.
Figure 4:
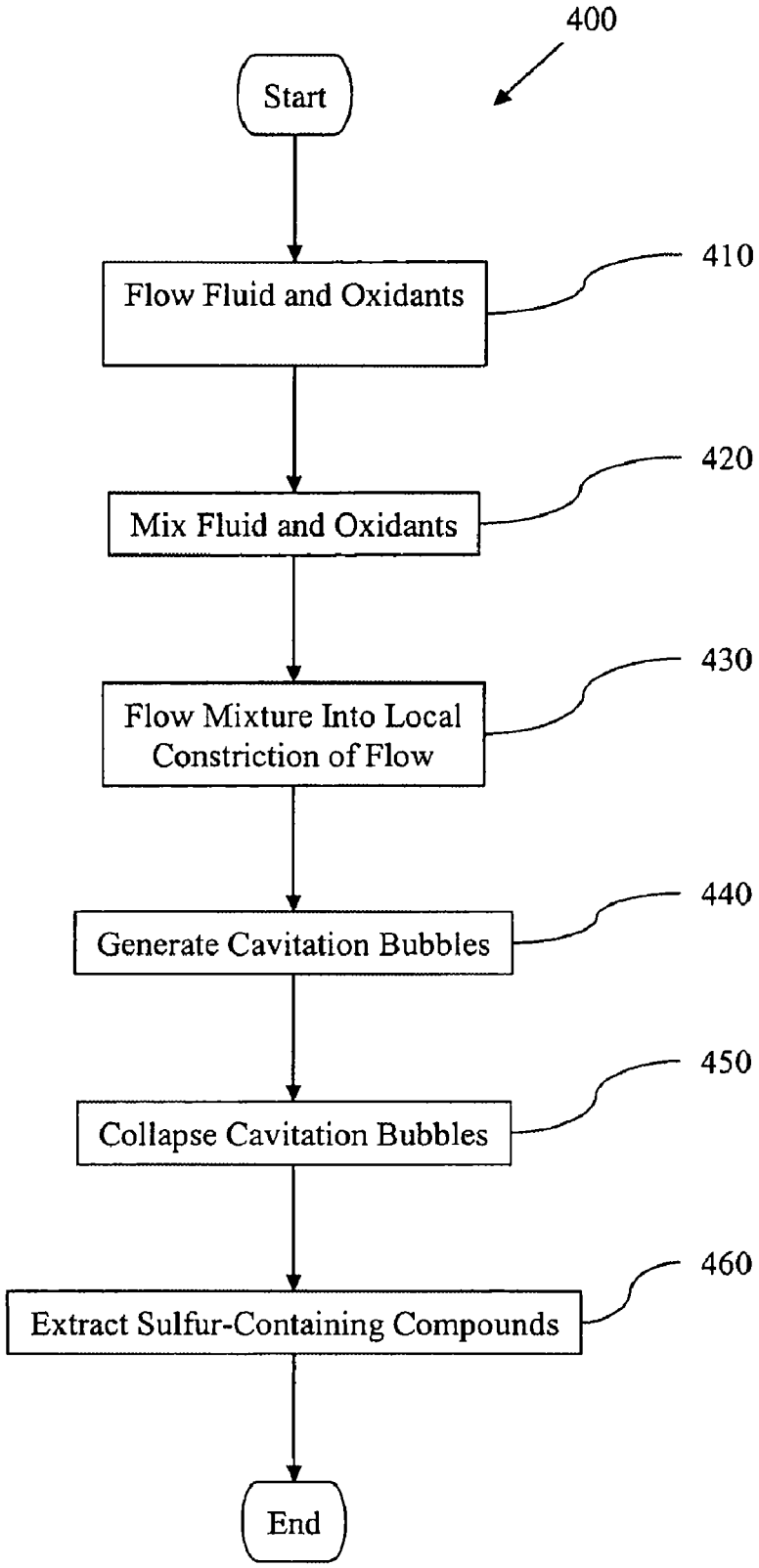
FIG. 4 is a flow diagram illustrating an example desulfurization method 400.

Oxidizing sulfur-containing compounds in a fluid may be better appreciated by reference to the flow diagrams of FIGS. 2, 3, and 4. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks. While the figures illustrate various actions occurring in serial, it is to be appreciated that various actions could occur concurrently, substantially in parallel, and/or at substantially different points in time.

FIG. 2 is a flow diagram illustrating an example method 200 for oxidizing sulfur-containing substances in a fluid. Method 200 may include, at 210, producing hydrodynamic cavitation in a mixture of a carbonaceous fluid containing sulfur-containing substances and one or more oxidants. Method 200 may also include, at 220, oxidizing and/or partially oxidizing at least some of the sulfur-containing substances. The hydrodynamic cavitation may initiate one or more chemical reactions that produce the oxidation.

Producing cavitation bubbles in a fluid by hydrodynamic cavitation may occur in a variety of ways. In one example, a fluid is flowed through one or more locally-constricted areas. Flowing the fluid through the locally-constricted areas, under certain conditions (e.g., fluid pressure, flow rate, velocity, and size of local constriction), may produce a localized pressure drop in the fluid. In one example, if the local pressure of a fluid decreases below its boiling point, vapor-filled cavities and bubbles may form (e.g., cavitation bubbles). As the pressure then increases, for example when the fluid containing the cavitation bubbles is flowed through a zone or area of elevated pressure, the bubbles may collapse, thereby creating localized energy conditions that may catalyze or partially catalyze the oxidation reactions. In one example, a mixture of the carbonaceous fluid, oxidizing agents, and optional other substances, is flowed through locally-constricted areas multiple times. The fluid may also be flowed through zones of elevated pressure multiple times. For example, multiple locally-constricted areas and/or zones of elevated pressure may be in fluid communication with one another so that they are in series.

In one example, the hydrodynamic cavitation is controlled. Control of hydrodynamic cavitation may include one or more of, controlling forming cavitation bubbles, controlling collapsing of cavitation bubbles, and controlling the location in which the cavitation bubbles are either formed or collapsed. Controlling the hydrodynamic cavitation may regulate the amount of energy produced. This may regulate the amount of oxidation that may occur, for example. In one example, control of the hydrodynamic cavitation process may facilitate oxidizing sulfur-containing compounds but may not facilitate oxidizing other substances like petroleum-based substances.

FIG. 3 is a flow diagram illustrating an example method 300 for oxidizing sulfur-containing substances in a fluid. Method 300 may include, at 310, introducing one or more oxidizing agents into a solution containing one or more sulfur-containing compounds. Generally, a mixture of the oxidizing agents and the solution containing the sulfur-containing compounds is produced. Method 300 may also include, at 320, creating cavitation bubbles in the mixture by hydrodynamic cavitation. Method 300 may also include, at 330, collapsing the cavitation bubbles. Collapsing the cavitation bubbles generally may at least partially catalyze one or more oxidation reactions that at least partially oxidize at least some of the sulfur-containing compounds.

In one example, the one or more oxidizing agents and the solution containing the one or more sulfur-containing compounds are mixed together before hydrodynamic cavitation is used to produce cavitation bubbles. This may be called pre-mixing of the oxidizing agents, the solution containing the sulfur-containing compounds, and optional other substances. The pre-mixing may occur, for example, in a mixing chamber or reactor. The pre-mixing may also occur, for example, as the oxidizing agents and the solution containing sulfur-containing compounds flows through a pump. In another example, the oxidizing agents may be introduced into the solution containing the sulfur-containing compounds at or near the area where cavitation bubbles are formed. For example, the oxidizing agents may be introduced into the solution containing the sulfur-containing compounds at or near a locally-constricted area of flow.

Oxidizing agents may also be added to the solution containing sulfur-containing compounds multiple times. For example, oxidizing agents may be pre-mixed with the solution containing sulfur-containing compounds and also introduced at or near the area where cavitation bubbles are formed. In another example, the solution containing sulfur-containing compounds may be flowed through locally-constricted areas and zones of elevated pressure multiple times. In one example of this, oxidizing agents may be added to the solution one or more times before the solution flows through the individual locally-constricted areas.

In one example, the method 300 for oxidizing sulfur-containing substances in a fluid may include removing the at least partially-oxidized sulfur-containing compounds from the mixture. The oxidized or partially oxidized sulfur-containing compounds may be removed from the mixture in a variety of ways. For example, the oxidized or partially oxidized sulfur-containing compounds may be removed by methods including, for example, adsorption, decomposition, distillation, extraction, and others. These methods may be described in U.S. Pat. Nos. 3,647,683 to Kelly, 5,958,224 to Ho et al., and 6,402,940 and 6,406,616 to Rappas, the contents of all of which are herein incorporated by reference.

In one example, the oxidized or partially oxidized sulfur-containing compounds may be removed with a solvent (e.g., by selective extraction) in which the oxidized or partially oxidized compounds are soluble or at least more soluble than they are in the original carbonaceous fluid before it is subjected to hydrodynamic cavitation These solvents generally are solvents that are immiscible with the carbonaceous fluid containing the sulfur-containing compounds that have not been oxidized. These solvents generally may be polar solvents. Generally, the solvents may be sufficiently polar for the oxidized or partially-oxidized sulfur-containing compounds to be selectively soluble or more soluble in the solvent as compared to the mixture of the carbonaceous fluid and oxidizing agents. Generally, unoxidized sulfur-containing compounds are less soluble in the solvent as compared to the mixture of the carbonaceous fluid and oxidizing agents. In one example, the solvents may be one or more of, methanol, acetonitrile, dimethyl sulfoxide, furans, chlorinated hydrocarbons, trialkylphosphates, N-methylpyrrolidone, and others.

FIG. 4 is a flow diagram illustrating an example desulfurization method 400. The method may be used for removing sulfur-containing compounds from fluids like petroleum-based fluids, for example. Method 400 may include, at 410, flowing a petroleum-based fluid and one or more oxidizing agents into an apparatus that is capable of creating a mixture. In one example, the apparatus may be one or more of, a mixing tank and a pump. Method 400 may also include, at 420, mixing the petroleum-based fluid and the oxidizing agents to produce a mixture. Method 400 may also include, at 430, flowing the mixture into and through a local constriction of flow, which may include a local area of low pressure in a fluid flowing therethrough. Method 400 may also include, at 440, generating cavitation bubbles at, within or near the local constriction of flow. Method 400 may also include, at 450, collapsing the cavitation bubbles. Collapse of the cavitation bubbles may occur in an area or zone of elevated pressure. Collapse of the cavitation bubbles may produce heat, shearing, shockwaves, ultraviolet light, and other localized energy conditions. The energy conditions may catalyze or partially catalyze reactions oxidizing at least some of the sulfur-containing compounds. The oxidizing may be to sulfoxides and/or sulfones. Method 400 may also include, at 460, extracting the oxidized or partially oxidized sulfur-containing compounds from the mixture using a solvent that may not be miscible with the mixture. The extracting generally leaves a product that may have a concentration of one or more sulfur-containing compounds lower than the starting petroleum-based fluid.

In one example, the mixture that contains the oxidized and/or partially oxidized sulfur-containing compounds may be recirculated back through all or part of the processes illustrated in FIGS. 2, 3 and 4. This process may be called a continuous process, in contrast to a batch process where the mixture may not be recirculated. Catalysts and/or additional oxidizing agents may be added during the recirculation.

Systems configured to oxidize sulfur-containing substances in a fluid and, optionally, to remove the oxidized sulfur-containing substances from the fluid are illustrated in FIGS. 5, 6, 7, 8 and 9. As illustrated in the figures, the example systems may include different combinations and arrangements of components such as reservoirs, conduits, mixing chambers, pumps, cavitation chambers, valves, and other components. The illustrated systems are examples of combinations and arrangements of components that may be used and are not meant to be limiting. Skilled artisans will recognize that different combinations and arrangements of some or all of the illustrated components may be devised. Other systems may have components in addition to those illustrated in the figures.

Figure 5:
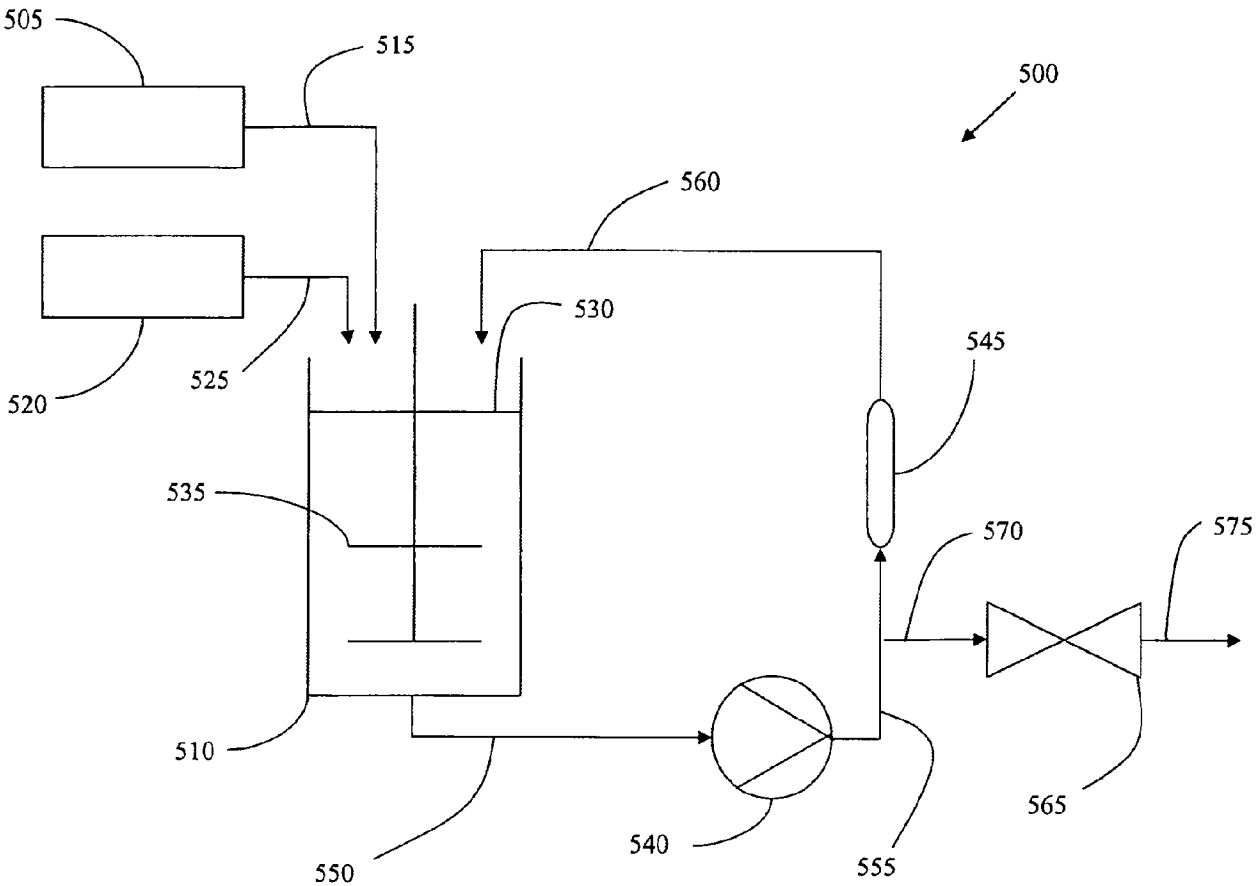
FIG. 5 is a system diagram illustrating an example system 500 for oxidizing sulfur-containing substances in a fluid by hydrodynamic cavitation.

FIG. 5 is a system diagram illustrating an example system 500 for oxidizing sulfur-containing substances in a fluid utilizing hydrodynamic cavitation. The example system 500 may include at least one first reservoir 505 configured to contain a carbonaceous fluid. The first reservoir 505 may be configured to facilitate flow of the carbonaceous fluid into a mixing device, which may be one or more of, a mixing tank, chamber or reactor 510, and a pump 540. The system may include a first conduit 515, that provides fluid communication between the first reservoir 505 and the mixing device. The example system 500 may include at least one second reservoir 520 configured to contain one or more oxidizing agents. The second reservoir 520 may be configured to facilitate flow of the carbonaceous fluid into one or more of, the mixing tank 510, and the pump 540. The system may include a second conduit 515, that provides fluid communication between the second reservoir 520 and the mixing device. In one example, substances like catalysts and surface active agents may be contained in one or more of, the first reservoir 505, and the second reservoir 520. The system 500 may include one or more additional reservoirs configured to contain substances like catalysts, surface active agents, and other substances.

An example mixing tank 510 may be configured to hold the carbonaceous fluids and oxidizing agents 530 that have flowed into the tank 510. The mixing tank or mixing reactor 510 generally may be configured to produce a mixture from the components that are added to the tank 510. In one example, the mixing tank may have blades 535 configured to rotate to produce the mixture. It will be appreciated that many different designs of a mixing tank 510 are possible.

An example pump 540 may be configured to produce a mixture from the components that flow therethrough. The pump 540 may also be configured to facilitate flow of the mixture through the system 500 and into a cavitation chamber 545. More specifically, the pump 540 can be configured to control the flow rate of fluid through the system 500. In one example, the pump 540 may be configured to pressurize the fluid at a pressure between about 620 kPa and 2,000 kPa and produce a flow rate of between about 0.8 $m^3$/hr and 10,000 $m^3$/hr. One example type of pump may be a centrifugal pump. It will be appreciated that other pump designs may be used.

In the illustrated system, a third conduit 550 provides fluid communication between the mixing tank 510 and the pump 540. As will be seen from a discussion of additional example systems that follow, this configuration of a mixing tank 510 in fluid communication with a pump 540 is only one of many possible configurations and arrangements that may be used.

Figure 10:
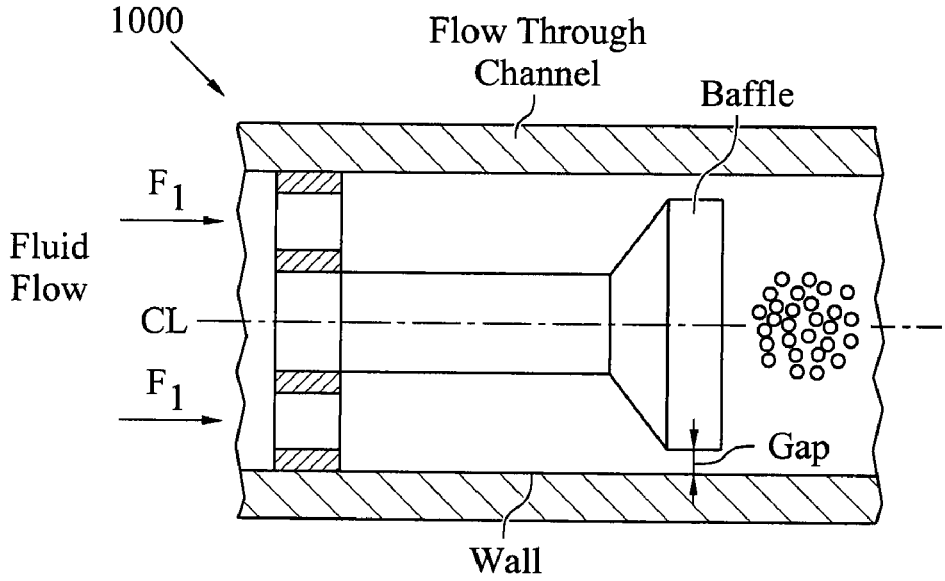
FIG. 10 illustrates a cross-sectional view of an example baffle-type cavitation chamber 1000 that can be used in one of the systems for oxidizing sulfur-containing substances in a fluid by hydrodynamic cavitation.
Figure 11:
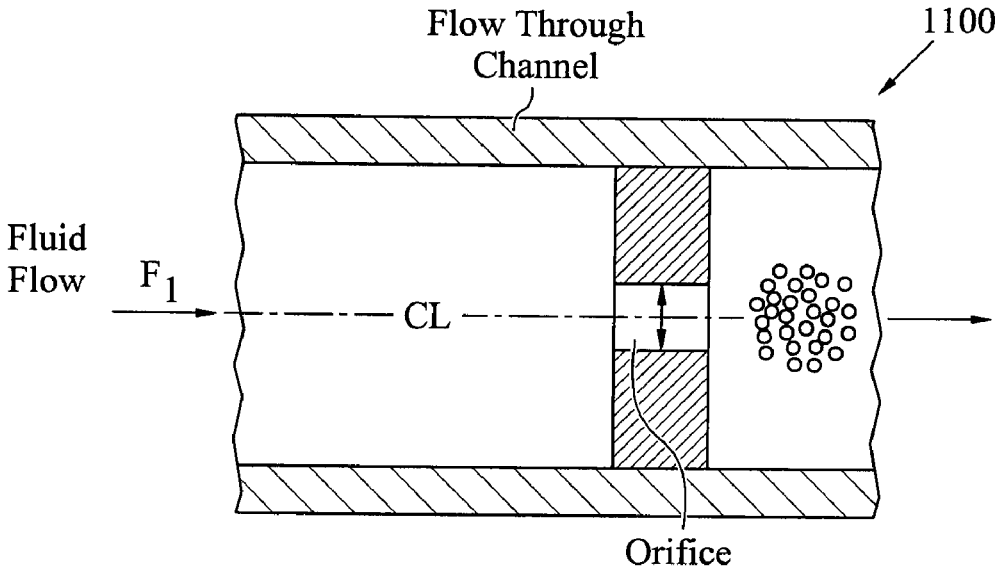
FIG. 11 illustrates a cross-sectional view of an example orifice-type cavitation chamber 1100 that can be used in one of the systems for oxidizing sulfur-containing substances in a fluid by hydrodynamic cavitation.

The illustrated system 500 also includes at least one cavitation chamber 545. Example cavitation chambers 545 may be of various designs. Generally, cavitation chambers 545 are configured to produce hydrodynamic cavitation in a fluid flowing therethrough. In one design, a cavitation chamber 545 produces one or more local areas of low pressure in a fluid flowing therethrough. The local areas of low pressure generally produce cavitation bubbles in the fluid. Exemplary cavitation chambers 545 include a baffle-type design and an orifice-type design that produces the local area of low pressure in the fluid. For example, in a baffle-type design (see FIG. 10), the local constriction of flow includes a gap defined between the baffle and a flow-through channel wall in the cavitation chamber 545. In one example, the size of the gap may be between about 120 microns and 5,000 microns. In an orifice-type design (see FIG. 11), the local constriction of flow includes a orifice or hole in a plate or other type of structure positioned within a flow-through channel in the cavitation chamber 545. In one example, the size of the orifice may be between about 120 microns and 5,000 microns. In both these examples, the local constriction of flow creates an increase in the velocity of the fluid flow to a minimum velocity (16 m/sec or greater for most fluids) that creates a sufficient pressure drop in the fluid flow to allow cavitation to occur. In one example, the gap or orifice is sufficiently sized (and the pressure and flow rate of the fluid are sufficiently controlled) to create a pressure drop of between about 620 kPa and 2,000 kPa.

Suitable examples of cavitation chambers 545 that can be used include those disclosed in U.S. Pat. Nos. 5,810,052, 5,937,906, 5,969,207, 5,971,601, 6,012,492, and 6,502,979, all to Kozyuk, the contents of all of which are herein incorporated by reference. It will be appreciated that cavitation chambers of other designs may also be used. An example cavitation chamber 545 may also be configured to collapse cavitation bubbles. In other examples, collapse of cavitation bubbles may not be a property of the cavitation chamber, but may be included elsewhere within the example system 500.

The example system 500 is configured for continuous flow of the mixture therethrough. The system 500 includes a fifth conduit 560 providing fluid communication between the cavitation chamber 545 and the mixing tank 510. This design may provide for a mixture to circulate through the system multiple times (e.g., recirculate). This design may facilitate continuous flow of a mixture therethrough. As will be seen from discussion of additional example systems that follow, other designs may not facilitate recirculation. In these systems, a mixture may flow through the system one time. These designs may facilitate batch flow of a mixture therethrough.

Continuous and batch systems may have one or more valves that facilitate flow of the mixture out of a system. As illustrated in example system 500, a valve 565 may be included. One example valve 565 may be configured, in one arrangement, to facilitate flow of the mixture therethrough and out of the system 500. This example valve 565 may also be configured, in another arrangement, to prevent flow of the mixture therethrough and keep the mixture within the system 500. In one example, the valve may be in fluid communication with the system 500 through a sixth conduit 570. A seventh conduit 575 may be in fluid communication with the valve 565 and may permit flow of the mixture from the valve 565, out of the system 500.

In operation of the system 500, a carbonaceous fluid containing sulfur-containing substances and one or more oxidizing agents may flow into the mixing tank 510, from the first reservoir 505 and second reservoir, respectively. The system may provide means for controlling or regulating the flow of the materials out of the reservoirs and into the mixing tank 510. The mixing tank 510 may mix the fluid and oxidizing agents to produce a mixture, by rotation of the blades 535, for example. The pump 540 may provide forces that flow the mixture from the mixing tank 510, through the pump 540, and into and through the cavitation chamber 545. The system may provide means for controlling or regulating the flow of the materials from the mixing tank 510 and into the cavitation chamber 545. In one example, the pump 540 may provide this control. By flowing the mixture into and through the cavitation chamber 545, a pressure drop in the flowing fluid may be created, thereby generating hydrodynamic cavitation in the flowing mixture. The magnitude (also known as power or energy density) of the hydrodynamic cavitation generated by the pressure drop in the flowing mixture may be between about 2,700 kWatts/cm$^2$ and about 56,000 kWatts/cm$^2$ measured at the surface of the local constriction of flow (gap or orifice) along the flow-through channel normal to the direction of fluid flow. Preferably, the magnitude of the hydrodynamic cavitation generated by the pressure drop in the flowing mixture is between about 3,600 kWatts/cm$^2$ and about 56,000 kWatts/cm$^2$ measured at the surface of the local constriction of flow (gap or orifice) along the flow-through channel normal to the direction of fluid flow.

The hydrodynamic cavitation generated in the flowing mixture may initiate or catalyze oxidation reactions that oxidize sulfur-containing compounds in the mixture. The mixture containing oxidized sulfur-containing compounds may flow back into the mixing tank 510 where additional oxidizing agents may be added. The mixture again may flow through the continuous system 500. This cycle may occur multiple times. At some point in time, the valve 565 may permit some of the mixture to flow out of the system 500, where it may be subjected to methods for removing the oxidized or partially oxidized sulfur-containing compounds from the mixture. Flow of some of the mixture out of the system may facilitate flow of additional carbonaceous fluid and/or oxidizing agents from the first reservoir 505 and second reservoir 520, respectively, into the system 500.

Figure 6:
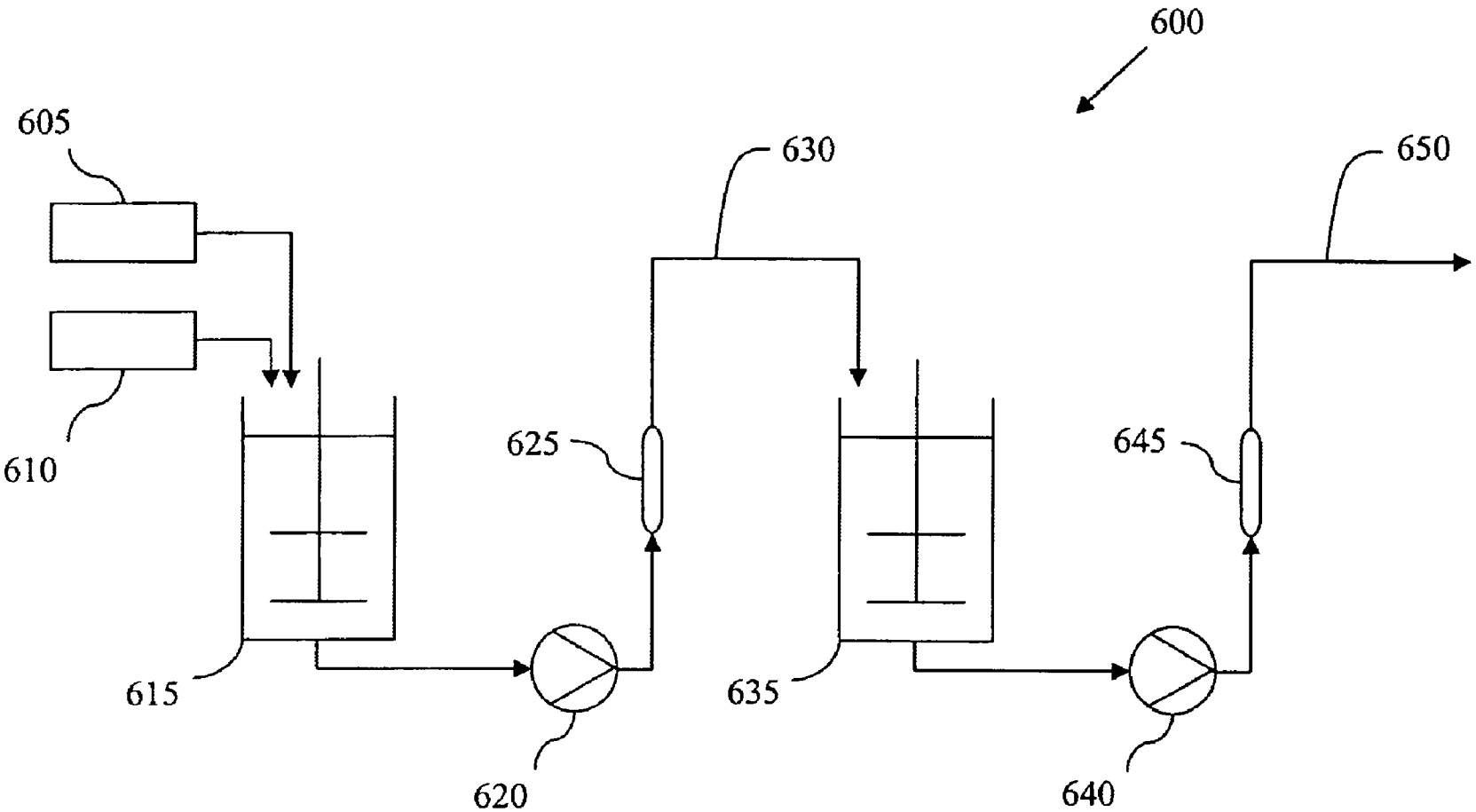
FIG. 6 is a system diagram illustrating another example system 600 for oxidizing sulfur-containing substances in a fluid by hydrodynamic cavitation.

FIG. 6 is a system diagram illustrating an example system 600 for oxidizing sulfur-containing substances in a fluid utilizing hydrodynamic cavitation. This example system 600 is configured as a batch system. The illustrated system 600 may include a first reservoir 605 configured to contain a carbonaceous fluid, and a second reservoir 610 configured to contain one or more oxidizing agents. The example system 600 may include a first mixing tank 615 in fluid communication with a first pump 620 that is in fluid communication with a first cavitation chamber 625. The first cavitation chamber 625 may be in fluid communication with a second mixing tank 635 through a first conduit 630. The second mixing tank 635 may be in fluid communication with a second pump 640 that is in fluid communication with a second cavitation chamber 645. The system may include a second conduit 650 that may facilitate flow of the mixture out of the system 600 or to one or more additional combinations or arrangements of one or more mixing tanks, pumps, cavitation chambers, valves, and so on.

Figure 7:
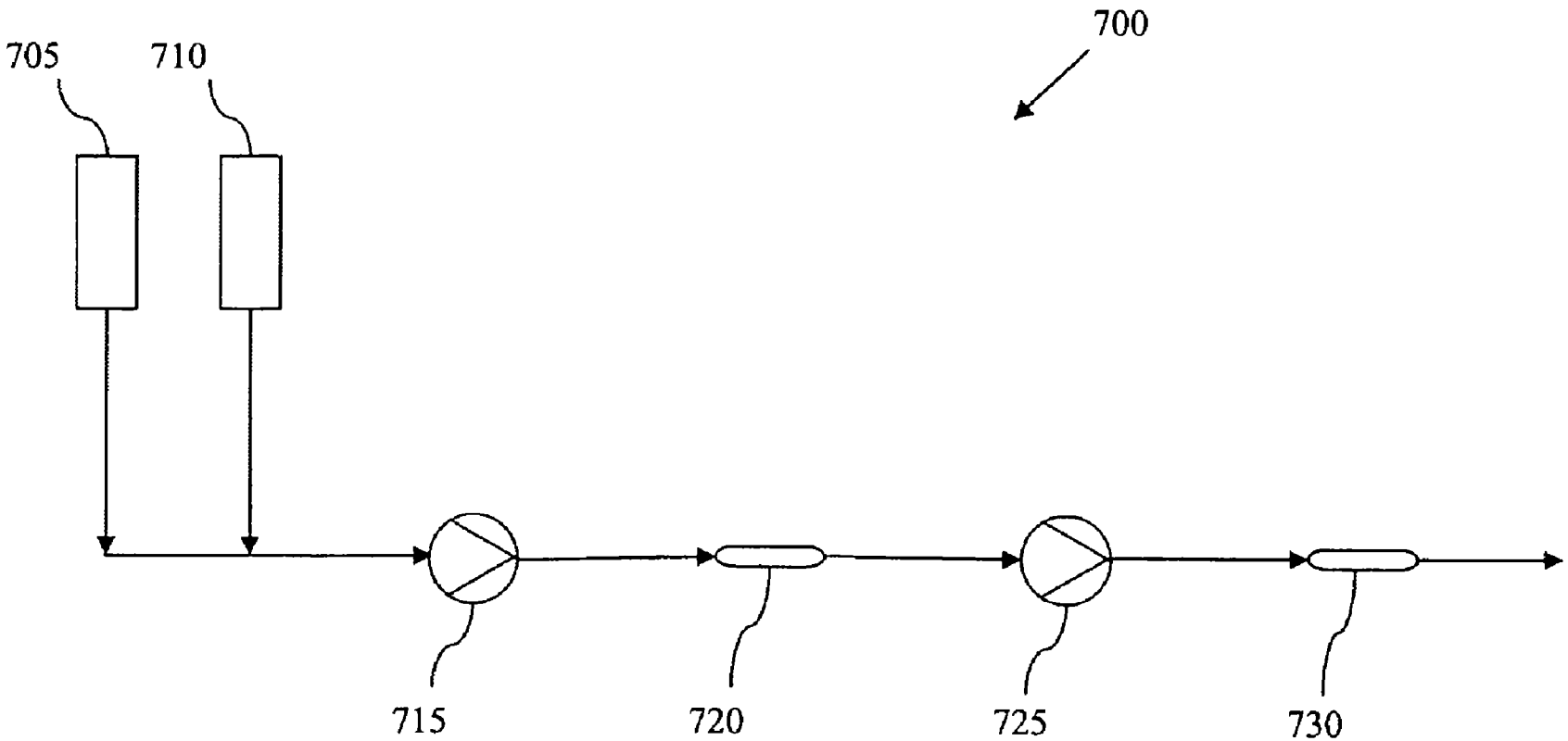
FIG. 7 is a system diagram illustrating yet another example system 700 for oxidizing sulfur-containing substances in a fluid by hydrodynamic cavitation.

FIG. 7 is a system diagram illustrating an example system 700 for oxidizing sulfur-containing substances in a fluid utilizing hydrodynamic cavitation. This example system 700 is configured as a batch system. The illustrated system 700 may include a first reservoir 705 configured to contain a carbonaceous fluid and a second reservoir 710 configured to contain one or more oxidizing agents. The example system 700 may include a first pump 715 that is in fluid communication with a first cavitation chamber 720. The first cavitation chamber 720 may be in fluid communication with a second pump 725. The second pump 725 may be in fluid communication with a second cavitation chamber 730, and so on.

Figure 8:
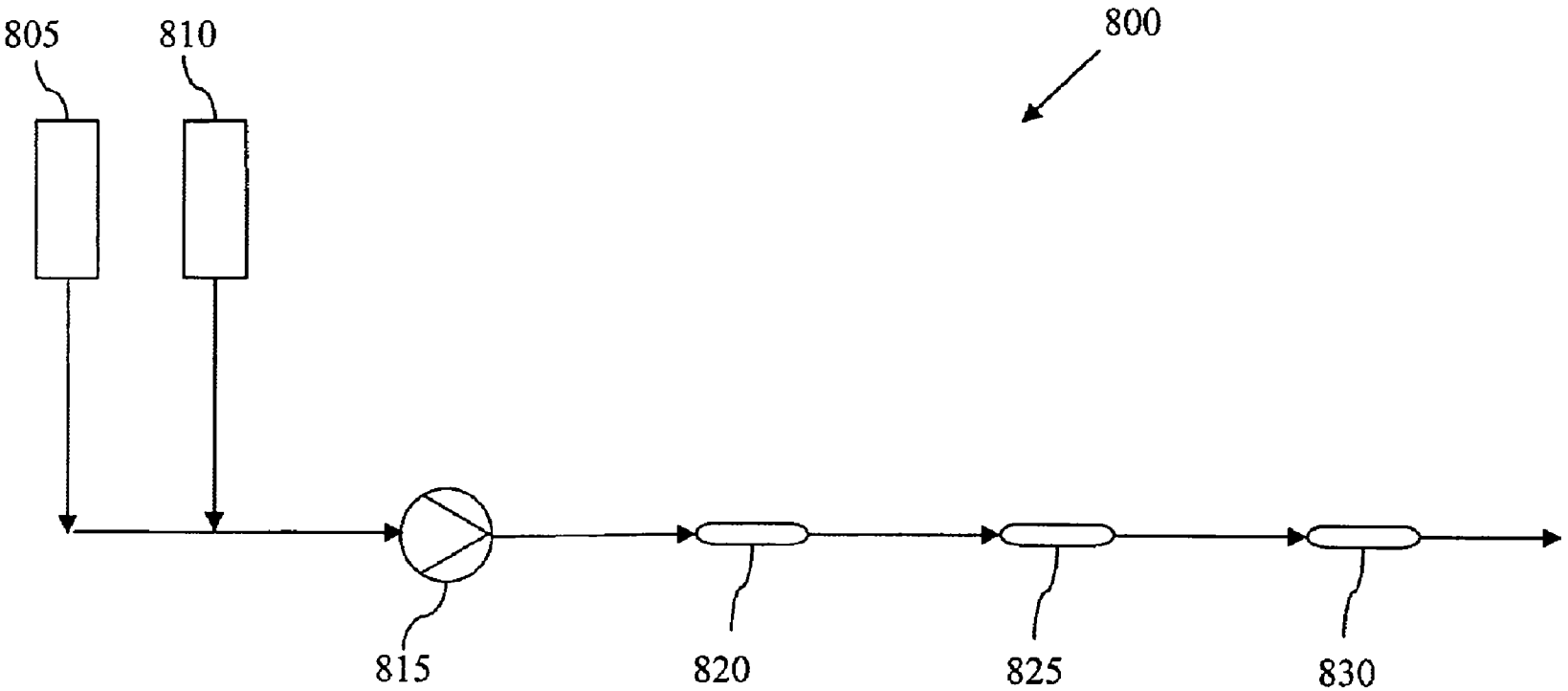
FIG. 8 is a system diagram illustrating yet another example system 800 for oxidizing sulfur-containing substances in a fluid by hydrodynamic cavitation.

FIG. 8 is a system diagram illustrating an example system 800 for oxidizing sulfur-containing substances in a fluid utilizing hydrodynamic cavitation. This example system 800 is configured as a batch system. The illustrated system 800 may include a first reservoir 805 configured to contain a carbonaceous fluid and a second reservoir 810 configured to contain one or more oxidizing agents. The example system 800 may include a pump 815 that is in fluid communication with a series of cavitation chambers. In the illustrated system 800, the pump 815 is in fluid communication with a first cavitation chamber 820 that is in fluid communication with a second cavitation chamber 825 that is in fluid communication with a third cavitation chamber 830. In other examples, additional or fewer cavitation chambers, pumps, mixing chambers, valves, and so on, may also be included.

Figure 9:
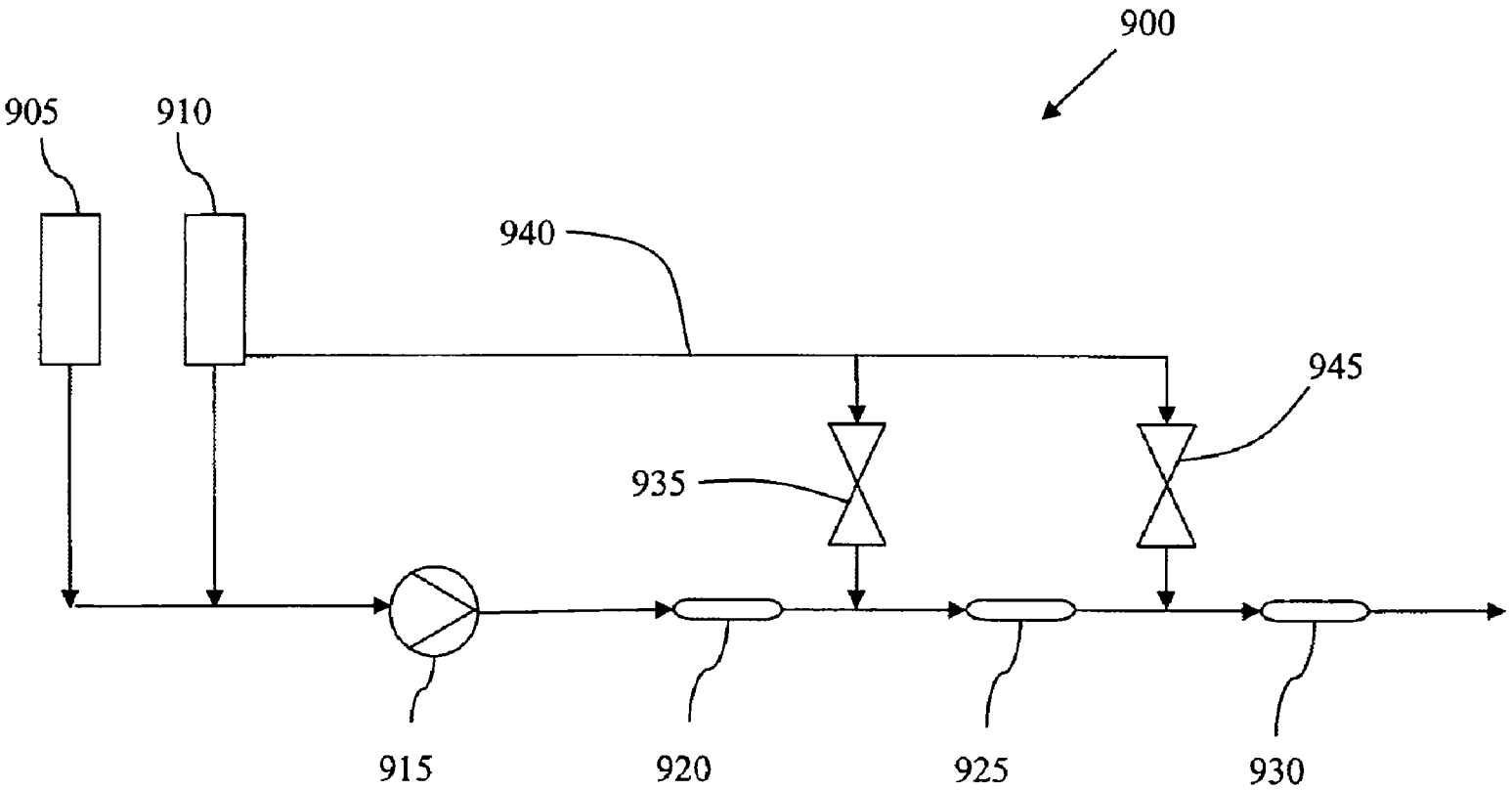
FIG. 9 is a system diagram illustrating yet another example system 900 for oxidizing sulfur-containing substances in a fluid by hydrodynamic cavitation.

FIG. 9 is a system diagram illustrating an example system 900 for oxidizing sulfur-containing substances in a fluid utilizing hydrodynamic cavitation. This example system 900 is configured as a batch system. The illustrated system 900 may include a first reservoir 905 configured to contain a carbonaceous fluid and a second reservoir 910 configured to contain one or more oxidizing agents. The example system 900 may include a pump 915 that is in fluid communication with a series of cavitation chambers. In the illustrated system 900, the pump 915 is in fluid communication with a first cavitation chamber 920 that is in fluid communication with a second cavitation chamber 925 that is in fluid communication with a third cavitation chamber 930. In the illustrated system 900, the second reservoir 910 may be in fluid communication with valves that are configured to facilitate addition of oxidizing agents into a mixture flowing through the system 900 at points downstream from the pump 915. In the illustrated example, a first valve 935 may be in fluid communication with the second reservoir 910 and a point of the system 900 located between the first cavitation chamber 920 and the second cavitation chamber 925 through a conduit 940. In the illustrated example, a second valve 945 may be in fluid communication with the second reservoir 910 and a point of the system 900 located between the second cavitation chamber 925 and the third cavitation chamber 930 through the conduit 940. In operation, this system design, and similarly designed systems, facilitate adding additional oxidizing agents to the mixture after the mixture has flowed through one cavitation chamber and before the mixture flows through a second cavitation chamber.

EXAMPLE

The example is for the purpose of illustrating an embodiment and is not to be construed as a limitation.

Example 1

Oxidative Desulfurization of Diesel Fuel Using Hydrodynamic Cavitation

The carbonaceous fluid was diesel fuel that contained 0.036 weight percent sulfur. The oxidizing agent was a 30 weight percent solution of hydrogen peroxide in water. The system used in this example was similar to the example apparatus 500 illustrated in FIG. 5 and included a mixing chamber having a 10 liter capacity, a cavitation chamber similar to the design shown in FIG. 10, and a centrifugal pump for circulating fluid through the system. The cavitation chamber included a single cone positioned inside a flow-through channel, such that a gap or local constriction of flow is formed between the cone and the flow-through channel. The size of the gap between the cone and the flow-through channel was 300 microns.

Initially, the oxidizing agent was mixed with the diesel fuel in the mixing chamber to yield a final hydrogen peroxide concentration of 2.5 weight percent. The mixture of diesel fuel and hydrogen peroxide was then circulated at a flow rate of 951.5 $m^3$/hr for ten minutes through the system, including the cavitation chamber, via the centrifugal pump. By flowing the mixture through the gap in the cavitation chamber at this flow rate, a pressure drop of 951.5 kPa was created in the flowing mixture, thereby generating hydrodynamic cavitation in the flowing mixture at a magnitude (power density) of 3716 kWatts/$cm^2$ measured at the surface of the gap along the flow-through channel normal to the fluid flow through the flow-through channel.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

I claim:

1. A method for oxidation of sulfur-containing substances in a carbonaceous fluid, the method comprising:

combining the carbonaceous fluid with at least one oxidant to form a mixture; and flowing the mixture through at least one local constriction in a flow-through chamber at a sufficient pressure and flow rate to generate a pressure drop across the at least one local constriction of at least 620 kPa and create hydrodynamic cavitation in the flowing mixture thereby regulating a power density of between about 3,600 kWatts/$cm^2$ and about 56,000 kWatts/$cm^2$ measured at the surface of the local constriction normal to the direction of fluid flow wherein the hydrodynamic cavitation is controlled such that selective oxidation of the sulfur-containing substances is facilitated but not the carbonaceous fluid.

2. The method of claim 1, where flowing the mixture through the one or more locally-constricted areas of the flow-through chamber produces one or more localized areas of low pressure in the mixture.

3. The method of claim 1, where flowing the mixture through the one or more locally-constricted areas of the flow-through chamber includes one or more of, flowing the mixture through the same flow-through chamber more than one time, and flowing the mixture through multiple flow-through chambers that are in fluid communication with one another.

4. The method of claim 1, where producing hydrodynamic cavitation includes collapsing the cavitation bubbles to produce one or more of, local high-shear conditions, shock-waves, ultraviolet light, and heating conditions.

5. The method of claim 4, where the oxidation reaction occurs in one or more of, a first area that includes cavitation bubbles that are collapsing, have collapsed, or are collapsing and have collapsed, and a second area that includes an area surrounding the first area that includes cavitation bubbles that have not collapsed.

6. The method of claim 1, where the carbonaceous fluid includes petroleum-based substances.

7. A method, comprising:

introducing one or more oxidizing agents into a solution containing a carbonaceous fluid having one or more sulfur-containing compounds to produce a flowing mixture;

creating cavitation bubbles in the flowing mixture by passing the flowing mixture through a local constriction of a flow-through chamber at a sufficient pressure and flow rate to generate a pressure drop across the local constriction of at least 620 kPa; and collapsing the cavitation bubbles to regulate the hydrodynamic power having a power density of between about 3,600 kWatts/cm$^2$ and about 56,000 kWatts/cm$^2$ measured at the surface of the local constriction normal to the direction of fluid flow, to thereby control the collapse of the cavitation of bubbles such that selective oxidation of the sulfur-containing compounds is facilitated but not the carbonaceous fluid.

8. The method of claim 7, where the one or more oxidizing agents are introduced into the solution containing one or more sulfur-containing compounds at the local constriction of the flow-through chamber.

9. The method of claim 7, where the mixture is produced by pre-mixing the one or more oxidizing agents and the solution containing one or more sulfur-containing compounds.

10. The method of claim 7, where the one or more oxidizing agents include hydroperoxides.

11. The method of claim 7 where the one or more oxidizing agents include one or more of, organic peroxy acids, inorganic peroxy acids, and peroxy salts.

12. The method of claim 7, where the one or more oxidizing agents include hydrogen peroxide and water.

13. The method of claim 7, including introducing one or more catalysts into one or more of, the oxidizing agents, the solution containing one or more sulfur-containing compounds, and the mixture.

14. The method of claim 7, including removing the oxidized sulfur-containing compounds from the mixture.

15. The method of claim 14, where removing the oxidized sulfur-containing compounds includes one or more of, adsorption, decomposition, distillation, and extraction.

16. The method of claim 7, including extracting the oxidized sulfur-containing compounds with a substantially polar solvent.

17. The method of claim 16, where the substantially polar solvent includes one or more of, methanol, acetonitrite, dimethyl sulfoxide, a furan, a chlorinated hydrocarbon, a trialkylphosphate, and N-methylpyrrolidone.

18. A method for removing sulfur-containing compounds from a petroleum-based fluid containing one or more sulfur-containing compounds that are substantially apolar, comprising:

flowing the petroleum-based fluid and one or more oxidants into one or more of, a mixing tank, and a pump;

mixing the petroleum-based fluid and the one or more oxidants in one or more of, the mixing tank, and the pump, to produce a mixture;

flowing the mixture from one or more of, the mixing tank, and the pump, into at least one local constriction of flow in a flow-through chamber;

generating cavitation bubbles within the at least one local constriction of flow by passing the mixture through the at least one local constriction at a sufficient pressure and flow rate to generate a pressure drop across the at least one local constriction of at least 620 kPa;

collapsing the cavitation bubbles in one or more elevated pressure zones to regulate the hydrodynamic power having a power density of between about 3,600 kWatts/cm$^2$ and about 56,000 kWatts/cm$^2$ measured at the surface of the local constriction normal to the direction of fluid flow, to thereby control the collapse of the cavitation bubbles such that selective oxidation of the sulfur-containing compounds is facilitated but not the petroleum-based fluid, wherein at least some of the substantially apolar sulfur-containing compounds are oxidized to substantially polar sulfur-containing compounds including one or more of, sulfoxides and sulfones;

extracting the substantially polar sulfur-containing compounds from the mixture using a substantially polar solvent that is not miscible with the mixture, the extracting leaving a product having a lower concentration of sulfur-containing compounds than the petroleum-based fluid.

19. The method of claim 18, including recirculating the mixture that contains one or more of, sulfoxides and sulfones, back through one or more of, the mixing tank, the pump, and the flow-through chamber.

20. The method of claim 19 including flowing one or more catalysts into the petroleum-based fluid.

21. The method of claim 20, where the one or more catalysts include one or more of, molybdenum, copper, iron, vanadium, and nickel.

22. The method of claim 20, where the one or more catalysts include formic acid.

* * * * *